US006482790B2

(12) United States Patent
Srinivas et al.

(10) Patent No.: US 6,482,790 B2
(45) Date of Patent: Nov. 19, 2002

(54) LAUNDRY DETERGENT COMPOSITIONS CONTAINING WATER SOLUBLE DYE COMPLEXING POLYMERS

(75) Inventors: Bala Srinivas, Hasbrouck Heights, NJ (US); Jenn S. Shih, Paramus, NJ (US)

(73) Assignee: ISP Investments Inc., Wilmington, DE (US)

( * ) Notice: Subject to any disclaimer, the term of this patent is extended or adjusted under 35 U.S.C. 154(b) by 0 days.

(21) Appl. No.: 09/730,423

(22) Filed: Dec. 5, 2000

(65) Prior Publication Data

US 2002/0103097 A1 Aug. 1, 2002

(51) Int. Cl.[7] ..... C11D 7/26; C11D 7/32; C11D 7/22

(52) U.S. Cl. ..... 510/360; 510/361; 510/476; 510/500

(58) Field of Search ..... 510/360, 361, 510/476, 500

(56) References Cited

U.S. PATENT DOCUMENTS

| | | | | | |
|---|---|---|---|---|---|
| 5,458,809 | A | * | 10/1995 | Fredj et al. | 252/543 |
| 5,627,151 | A | * | 5/1997 | Detering et al. | 510/475 |
| 5,776,879 | A | * | 7/1998 | Shih et al. | 510/361 |
| 5,869,442 | A | * | 2/1999 | Srinivas et al. | 510/476 |
| 5,929,175 | A | * | 7/1999 | Shih et al. | 525/359.3 |

FOREIGN PATENT DOCUMENTS

| | | | |
|---|---|---|---|
| EP | 754748 | * | 1/1997 |

* cited by examiner

*Primary Examiner*—Gregory Delcotto
(74) *Attorney, Agent, or Firm*—Walter Katz; William J. Davis; Marilyn J. Maue

(57) ABSTRACT

This invention relates to laundry detergent compositions, and, more particularly, to such compositions containing water soluble poly(vinylpyridine) betaine polymers containing a quaternary nitrogen and a carboxylic acid group, which polymers have effective dye complexing properties therein.

9 Claims, No Drawings

LAUNDRY DETERGENT COMPOSITIONS CONTAINING WATER SOLUBLE DYE COMPLEXING POLYMERS

BACKGROUND OF THE INVENTION

1. Field of the Invention

This invention relates to laundry detergent compositions, and, more particularly, to such compositions containing a polymer which is a water soluble poly(vinylpyridine) betaine containing a quaternary nitrogen and a carboxylic acid group, which polymers have effective dye complexing properties therein.

2. Description of the Prior Art

Dye complexing polymers have been used in laundry detergent and fabric softener compositions. In such application, during washing a mixture of colored and white fabrics, some of the dyes may bleed out of a colored fabric under washing conditions. The degree of bleeding is influenced by the structure of the dye, the type of cloth and the pH, temperature and mechanical efficiency of the agitation process. The bled dye in the wash liquor can be totally innocuous and get washed off in the wash liquor. However, in reality, this fugitive dye has a tendency to redeposit either onto the same fabric or onto another fabric leading to patches and an ugly appearance of the washed material. This redeposition of the bled dye can be inhibited in several ways. One method is to introduce compounds which can complex with the fugitive dye and get washed off thus preventing redeposition.

Polyvinylpyrrolidone (PVP), by virtue of its dye complexation ability, has been used to inhibit dye deposition during washing of colored fabrics under laundry conditions. The performance of PVP as a DTI, however, is adversely affected by the presence of anionic surfactants in the washing process.

Other polymers which have been used as DTIs in laundry detergent compositions include polyvinylpyridine N-oxide (PVPNO); polyvinylimidazole (PVI) and copolymers of polyvinylpyridine and polyvinylimidazole (PVP-PVI).

U.S. Pat. Nos. 5,776,879; 5,929,175; 5,869,442; 5,863,880, assigned to the same assignee as herein are related to this invention.

The other prior art in this field is represented by the following patents and publications:

| Patent | Subject Matter |
|---|---|
| (1) JP 53-50732 | Formulas Nos. 3, 6 and (1) are water insoluble compounds and polymers used in printing ink compositions; |
| (2) PCT/US94/06849 WO 95/03390 | Dye inhibiting composition polymers of PVP, polyamine N-oxide, vinylimidazole are used in laundry detergent compositions; |
| (3) U.S. Pat. No. 5,460,752 | Polyamine N-oxide polymers described for use in laundry detergent compositions; |
| (4) EPA 664335 A1 | Polysulfoxide polymers; |
| (5) PCT/US93/10542 WO 94/11473 | Laundry compositions include polyamine-N-oxide and brighteners and surfactants; |
| (6) PCT/EP93/02851 WO 94/10281 | PVP and PVI are present in laundry compositions; |
| (7) PCT/US94/11509 WO 95/13354 | Poly(4-vinylpyridine-N-oxide) (PVNO) and copolymers of VP and VI are described; |
| (8) EP 754748 A1 | Vinylpyridine copolymers and formic acid; |
| (9) 066433 A1 | Polyamine oxide polymers; |
| (10) U.S. Pat. No. 5,604,197 | PVPNO + clay softening; |
| (11) U.S. Pat. No. 5,458,809 | PVPNO; |
| (12) U.S. Pat. No. 5,466,802 | PVPNO and PVP-VI; |
| (13) U.S. Pat. No. 5,627,151 | Copolymers of VP or VI; vinylpyridine or dimethylaminoethyl methacrylate or dimethylaminopropylmethacrylamide, including up to 20% vinylacetate; |
| (14) PCT/US95/04019 WO 95/27038 | PVPNO, PVP, PVP-PI and copolymers of VP and VI; |
| (15) EPA 628624 A1 | PVPNO with protease; |
| (16) DE 4224762 A1 | VP polymers; |
| (17) J. Polymer Sci. 26, No. 113, p. 25–254 (1957) | Water-insoluble poly(4-vinylpyridine) compounds and polymers |

Accordingly, it is an object of this invention to provide new and improved laundry detergent compositions containing effective water soluble dye complexing polymers.

A feature of the invention is the provision of a water soluble poly(vinylpyridine) betaine containing a quaternary nitrogen and a carboxylic acid group as the dye transfer complexing polymer in laundry detergent compositions.

Another feature of the invention is the provision of laundry detergent compositions containing such new and improved water soluble poly(vinylpyridine) polymers, which exhibit color stability during storage, and particularly effective dye complexing properties during the washing process even in the presence of anionic surfactants.

SUMMARY OF THE INVENTION

What is described herein is a laundry detergent composition containing a water soluble poly(vinylpyridine betaine) polymer which contains a quaternary nitrogen and a carboxylic acid group. The polymer has the formula:

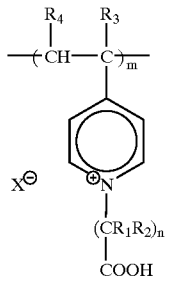

where m is indicative of the degree of polymerization,

X is an anion, $R_1$, $R_2$, $R_3$ and $R_4$ are independently hydrogen, alkyl or aryl, and n is 1–6, and quats and copolymers thereof.

Preferred embodiments of the invention are polymers in which X is hydroxyl; $R_1$, $R_2$, $R_3$ and $R_4$ are hydrogen; n is 1 or 2; and the polymer is 25–100% quaternized; most preferably 75–100%.

A suitable polymer has a weight average molecular weight of about 5,000 to 1,000,000; preferably 20,000 to 200,000, where m is about 30–5000, preferably 100–1000.

Water soluble copolymers of the defined polymer above with polymerizable comonomers, such as vinyl pyrrolidone, vinyl imidazole, acrylamide and vinyl caprolactam also are useful herein.

The polymers of the invention have effective dye complexing properties for use in laundry detergent compositions which include at least 1% by weight of an anionic, cationic or non-ionic surfactant or mixtures thereof.

DETAILED DESCRIPTION OF THE INVENTION

The dye transfer inhibition polymers of the invention wherein n=2–6 and X is OH are made by reacting a poly(vinylpyridine) with an α,β-unsaturated carboxylic acid by Michael addition. Suitable α,β-unsaturated acids in this reaction include crotonic acid, itaconic acid, maleic acid, fumaric acid, acrylic acid, methacrylic acid and the like. Crotonic acid is preferred. In aqueous medium the betaine anion is hydroxyl.

A preferred polymer herein is poly(4-vinylpyridine) carboxyethyl betaine hydroxide having the formula:

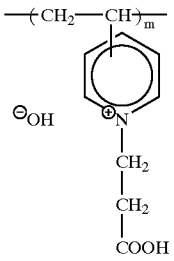

which is made by reacting poly(4-vinylpyridine) with crotonic acid to form the betaine carboxylate followed by addition of water to form the desired betaine carboxylic acid.

Polymers of the invention wherein n=1–6 and X is a halide are made by reacting poly(4-vinylpyridine) with a halocarboxylic acid such as 2-chloroacetic acid, 2 or 3-chloropropionic acid, and the like.

The invention will now be described in more detail with reference to the following examples.

EXAMPLE 1

Poly(4-Vinylpyridine)
(Solution Polymerization)

Into a 1-l, 4-necked resin kettle, fitted with a stainless steel anchor agitator, a nitrogen purge adapter and a reflux condenser, a mixture of 160 g of 4-vinylpyridine monomer and 440 g of isopropanol were charged. The nitrogen purge is begun and continued throughout the run. The above mixture at ambient temperature was then gradually heated to 75° C. and held for 30 minutes. 2.0 grams of initiator t-butylperoxy pivalate was charged while operating the anchor agitator at 350 rpm. The mixture was kept at 75° C. throughout the run. The resulting mixture was agitated for one hour. Then 0.5 g of Lupersol® 11 was added every hour until the residual 4-vinylpyridine level was less than 0.5%.

EXAMPLE 2

Poly(4-Vinylpyridine)
(Suspension Polymerization)

Into a 1-l, 4-necked resin kettle, fitted with a stainless steel anchor agitator, a nitrogen purge adapter and a reflux condenser, a mixture of 60 g of 4-vinylpyridine monomer, 3.0 g of K-30 poly(4-vinylpyrrolidone) and 240 g of water were charged. The nitrogen purge is begun and continued throughout the run. The above mixture at ambient temperature was then gradually heated and held at 85° C. for 30 minutes with the anchor agitator set at 350 rpm. An initial charge of 1.0 g. of t-butyl peroxypivalate (Lupersol® 11) was added to the mixture and agitation was continued for one hour. Then 0.5 g of Lupersol® 11 was added every hour over an 8-hour period until the residual 4-vinylpyridine level was less than 0.5%. The resulting poly(4-vinylpyridine) is recovered by filtering and drying in an 80% yield.

EXAMPLE 3

Poly(4-Vinylpyridine) and Crotonic Acid

Into a 1-l, 4-necked resin kettle fitted with a nitrogen gas adapter, reflux condenser, thermometer, and glass agitator with Teflon blade 90 g of isopropyl alcohol and 60 g of 4-vinylpyridine were charged. Agitation was started and kept at 200 rpm. Nitrogen was introduced into the kettle and continue throughout the polymerization reactions. The resulting mixture was gradually heated up from ambient temperature to 80° C. and held for about a half-hour. Then an initial charge of 0.6 g of t-butyl peroxypivalate (Lupersol® 11) was added to the mixture. After 2 hours, an additional dose of 0.3 g of initiator was also added every 2 hours until the residual 4-vinylpyridine monomer level was less than 0.5%. Meanwhile 24.6 g of crotonic acid (a 1:0.5 molar ratio of 4-vinylpyridine to crotonic acid) was completely dissolved in 127 g distilled water and the mixture was added to the kettle held at 80° C. After mixing for 10 minutes the isopropyl alcohol solvent was stripped completely from the batch by gradually applying vacuum. The batch was then held for 15 hours at 80° C. The reaction product is present in a 50% solids solution.

EXAMPLE 4

Poly(4-Vinylpyridine) and Crotonic Acid

Into a 1-l, 4-necked resin kettle fitted with a nitrogen gas adapter, reflux condenser, thermometer, and glass agitator with Teflon blade, 90 g of isopropyl alcohol and 60 g of 4-vinylpyridine are charged. Agitation was started and was held at 200 rpm. Nitrogen was introduced into the kettle and continue throughout the polymerization reactions. The above mixture was gradually heated up from ambient temperature to 80° C. and held for about a half-hour. An initial charge of 0.6 g of t-butyl peroxypivalate (Lupersol 11) was added to the mixture and was held for 2 hours. Then an additional dose of initiator 0.3 g Lupersol 11 was also added every 2 hours until the 4-vinylpyridine monomer level is less than 0.5%. Meanwhile 39 g of crotonic acid was completely dissolved in 127 g distilled water and the mixture was added to the kettle held at 80° C. After 10 minutes of mixing, the isopropyl alcohol solvent was stripped completely from the batch by gradually applying vacuum. The batch was then held for 15 hours at 80° C. The reaction product is recovered in an 80% solids solution.

EXAMPLE 5

Poly(4-Vinylpyridine) and Crotonic Acid

Into a 4-necked, 1-l reaction kettle, equipped with a thermometer, reflux condenser, and a half-moon Teflon blade agitator, was charged 60 g of poly(4-vinylpyridine) (Example 2) and 200 g of water. The mixture was heated to 80° C. with agitation; then 34 g of crotonic acid and 100 g of water was added to the kettle and the resulting mixture was heated at reflux temperature for 15 hours. The reaction product contains 70% crotonic acid.

EXAMPLE 6

Poly(4-Vinylpyridine) and Acrylic Acid (Solution Polymerization)

In the apparatus of Example 5, 160 g of poly(4-vinylpyridine) (Example 1) was charged as a 40% aqueous isopropyl alcohol solution. Agitate and heat the batch to 80° C. Then 23 g of acrylic acid was introduced and the resulting mixture was heated at reflux temperature for 8 hours. Then 200 g water was added, agitated and vacuum applied to strip off isopropyl alcohol. The reaction product was cooled and water added to a 40% solids level.

EXAMPLE 7

Poly(4-Vinylpyridine) and Crotonic Acid (Solution Polymerization) (Isopropyl Alcohol)

Into a 1-l, 4-necked resin kettle fitted with a nitrogen gas adapter, reflux condenser, thermometer, and glass agitator with Teflon blade, 90 g of isopropyl alcohol, 40 g of 4-vinylpyridine and 20 g of vinylpyrrolidone were charged. Agitation was started and was held at 200 rpm. Nitrogen was introduced into the kettle and continued throughout the polymerization reaction. The above mixture was gradually heated up from ambient temperature to 80° C. and held for about half-hour. An initial charge of 0.6 g (1% based on total monomer weight) of t-butyl peroxypivalate (Lupersol® 11) was added to the mixture which was then held for 2 hours. An additional dose of 0.3 g of initiator was added every 2 hours for 12 hours or until the residual 4-vinylpyridine monomer level was less than 0.5%. Meanwhile 24.6 g of crotonic acid was completely dissolved in 127 g distilled water and the mixture was added to the kettle held at 80° C. After 10 minutes of mixing, isopropyl alcohol was stripped completely from the batch by applying vacuum gradually. The batch was then held for 9 hours at 80° C. or until the residual crotonic acid level was less than 1.0%. The product is semi-viscous, has a dark brownish color and is soluble in water.

EXAMPLE 8

Poly(4-Vinylpyridine) and Itaconic Acid (Solution Polymerization) (Isopropyl Alcohol)

Into a 4-necked, 1-l reaction kettle, equipped with a thermometer, reflux condenser, and a half-moon Teflon blade agitator, charge 160 g of poly(4-vinylpyridine) (Example 1) 40% aqueous solution. Agitate and heat the batch to 80° C. Add 40 g of itaconic acid into the kettle and keep the mixture at reflux temperature for 15 hours. Add 200 g water and let it mix properly then apply vacuum to strip isopropyl alcohol. Cool down and readjust solid to 40%.

EXAMPLE 9

Poly(4-Vinylpyridine and Chloroacetic Acid (Solution Polymerization)

A 1-liter, 4-necked resin kettle was fitted with an anchor agitator, a nitrogen purge adaptor, a thermometer, two sub-surface feeding tubes connected with two feeding pumps, and a reflux condenser. The kettle was charged with 150 g of 4-vinylpyridine and 150 g of isopropanol. Nitrogen purging was started and continued throughout the process as was agitation at 200 rpm. Then the reactants were heated to 80° C. in 20 minutes and held at that for 30 minutes. Then 390 microliter of t-butyl peroxypivalate (Lupersol® 11) was charged. The solution polymerization reaction was carried out at 80° C. for 2 hours. Then a 195 microliter portion of Lupersol® 11 was added and reaction continued at 80° C. for another two hours. The latter step was repeated another 6 times. Then 150 g water and 135 g of chloroacetic acid was charged and the contents were rinsed with 100 g of water. The resultant mixture was heated to remove 100 g of distillate then 100 g of water was added to the mixture; the step was repeated and yet another 50 g of distillate was removed. Then the mixture was cooled to room temperature. The product was obtained as a solution whose solids level was adjusted to about 48%.

EXAMPLE 10

The process of Example 9 was repeated using 155 g of 3-chloropropionic acid. A related product was obtained.

While the invention has been described with particular reference to certain embodiments thereof, it will be understood that changes and modifications may be made which are within the skill of the art. Accordingly, it is intended to be bound only by the following claims, in which:

What is claimed is:

1. A laundry detergent composition having effective dye transfer inhibition properties, which includes a water soluble poly(vinylpyridine) betaine polymer having the formula:

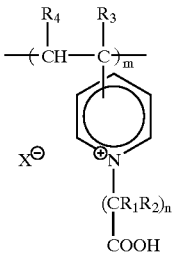

where m is from 30 to 5000,

X is an anion, $R_1$, $R_2$, $R_3$ and $R_4$ are independently hydrogen, alkyl or aryl, and n is 1–6, and quats and copolymers thereof.

2. A laundry detergent composition according to claim 1 in which X is hydroxyl, $R_1$, $R_2$, $R_3$ and $R_4$ are hydrogen, and n is 2.

3. A laundry detergent composition according to claim 1 in which X is a halide, $R_1$, $R_2$, $R_3$ and $R_4$ are hydrogen, and n is 1 or 2.

4. A laundry detergent composition according to claim 1 in which said polymer is 25 to 100% quaternized.

5. A laundry detergent composition according to claim 1 in which said polymer is present as a water soluble copolymer with a polymerizable monomer.

6. A composition according to claim 5 in which said monomer is vinylpyrrolidone, vinyl caprolactam, vinyl imidazole, N-vinyl formamide or acrylamide.

7. A composition according to claim 1 which has a weight average molecular weight of about 5,000 to 1,000,000.

8. A laundry detergent composition according to claim 1 containing about 0.01–10% by weight of said polymer.

9. A laundry detergent composition according to claim 1 containing about 0.05–1% of said polymer.

* * * * *